US009260212B2

(12) United States Patent
Monti

(10) Patent No.: US 9,260,212 B2
(45) Date of Patent: Feb. 16, 2016

(54) UNIT FOR PICKING UP A TUBULAR CONTAINER IN A FLATTENED CONFIGURATION, FOR OPENING OUT THE TUBULAR CONTAINER AND FOR TRANSFERRING THE TUBULAR CONTAINER TOWARDS A RECEIVING STATION OF THE TUBULAR CONTAINER

(71) Applicant: Marchesini Group S.p.A., Pianoro (Bologna) (IT)

(72) Inventor: Giuseppe Monti, Pianoro (IT)

(73) Assignee: MARCHESINI GROUP S.p.A., Pianoro (Bologna) (IT)

( * ) Notice: Subject to any disclaimer, the term of this patent is extended or adjusted under 35 U.S.C. 154(b) by 587 days.

(21) Appl. No.: 13/685,771

(22) Filed: Nov. 27, 2012

(65) Prior Publication Data

US 2013/0165307 A1 Jun. 27, 2013

(30) Foreign Application Priority Data

Dec. 23, 2011 (IT) ..... BO2011A0756

(51) Int. Cl.
*B31B 3/02* (2006.01)
*B65B 43/30* (2006.01)
*B65B 43/18* (2006.01)

(52) U.S. Cl.
CPC ..... *B65B 43/185* (2013.01); *B65B 43/305* (2013.01)

(58) Field of Classification Search
CPC .. B65B 43/305; B65B 43/265; B65B 43/185; B65B 43/08; B65B 43/285; B31B 3/02
USPC ..... 493/120, 126, 181, 212, 309, 313, 315, 493/316, 318; 53/468, 564, 565, 566, 573
See application file for complete search history.

(56) References Cited

U.S. PATENT DOCUMENTS

| | | | | |
|---|---|---|---|---|
| 5,473,868 | A * | 12/1995 | Antonio | 53/566 |
| 7,316,642 | B2 * | 1/2008 | Martelli | 493/309 |
| 7,803,099 | B2 * | 9/2010 | Biraud et al. | 493/313 |
| 2007/0079575 | A1 * | 4/2007 | Monti | 53/458 |
| 2007/0197364 | A1 * | 8/2007 | Monti | 493/316 |
| 2008/0300123 | A1 * | 12/2008 | Bonnain | 493/310 |
| 2009/0264269 | A1 * | 10/2009 | Monti | 493/52 |
| 2010/0043357 | A1 * | 2/2010 | Kobierzycki et al. | 53/458 |
| 2010/0125361 | A1 * | 5/2010 | Mougin et al. | 700/217 |

* cited by examiner

*Primary Examiner* — Hemant M Desai
*Assistant Examiner* — Valentin Neacsu
(74) *Attorney, Agent, or Firm* — Henry D. Coleman; R. Neil Sudol

(57) ABSTRACT

A unit for picking up and opening a tubular container has a first arm hinged to a frame at a first hinge axis, a second arm hinged at a second axis, and a third arm hinged to the first arm and to the second arm. The frame, first, second and third arms form a four-bar linkage. A fourth arm is hinged to the third arm and bears first aspirators. A fifth arm abuts the first sheet of the tubular container. In an initial pick-up configuration, the third arm is retracted and the fourth arm is in a retracted angular position so that the first aspirators intercept the first sheet. In a final release configuration, the third arm is in a second advanced position and the fourth arm is in a second advanced angular position such that the first aspirators can release the tubular container in a receiving station.

11 Claims, 6 Drawing Sheets

UNIT FOR PICKING UP A TUBULAR CONTAINER IN A FLATTENED CONFIGURATION, FOR OPENING OUT THE TUBULAR CONTAINER AND FOR TRANSFERRING THE TUBULAR CONTAINER TOWARDS A RECEIVING STATION OF THE TUBULAR CONTAINER

FIELD OF THE INVENTION

The present invention relates to the technical sector of packing articles, such as blister packs containing pills, internally of cardboard boxes; in particular, the invention relates to a unit for collecting a tubular container in a flattened configuration, for opening-out the tubular container and for transferring the tubular container towards a receiving station of the tubular container, where the tubular container can be filled with articles or be subjected to further handling/transfer.

DESCRIPTION OF THE PRIOR ART

Tubular containers are obtainable from tubular blanks which are initially in a flattened configuration such as to enable optimal storing thereof. Subsequently these containers are opened out in order that they can internally receive the articles; thereafter they are closed.

A tubular container in the flattened configuration comprises a first sheet and a second sheet, which are in contact with one another or in strict vicinity to one another; the first sheet is connected to the second sheet at the two common and opposite ends. The first sheet is provided with a first side and a second side, which are separated from one another by a fold line; likewise, the second sheet is provided with a third side and a fourth side which are separated from one another by a further fold line. Further provided are additional sides that function as closing flaps of the tubular container.

As is known, the opening-out of the container consists in distancing the first sheet and the second sheet from one another in order to define a parallelepiped having two opposite openings and formed by the first side, the second side, the third side and the fourth side. The two opposite openings are then closed, folding the additional sides of the tubular container which function as closing flaps.

SUMMARY OF THE INVENTION

The aim of the present invention consists in disclosing a mechanical device for collecting a tubular container in a flattened configuration in order to open it out and transfer it to a receiving station of the tubular container.

The above aim is obtained by means of a unit for picking up a tubular container in a flattened configuration, for opening out the tubular container and for transferring the tubular container towards a receiving station of the tubular container, the tubular container in the flattened configuration comprising a first sheet and a second sheet which are in contact with one another or in close vicinity to one another, the first sheet being connected to the second sheet at two common and opposite ends, the first sheet being provided with a first side and a second side that are separated from one another by a fold line, the tubular container being positionable in a pick-up position such as to form a first angle with respect to a horizontal plane and for making the first sheet available for picking-up of the tubular container, the unit being positionable adjacent to a receiving station of the tubular container and being characterized in that it comprises: a frame; a first arm hinged to the frame at a first hinge axis; a second arm hinged to the frame at a second hinge axis; a third arm which is hinged to the first arm at a third hinge axis and which is articulated to the second arm at a fourth hinge axis; the frame, the first arm, the second arm and the third arm forming a four-bar linkage; a fourth arm which is hinged to the third arm at a fifth hinge axis and which bears first aspirating means of the tubular container located at a first portion of the fourth arm; a fifth arm which is hinged to the fourth arm at a sixth hinge axis and which is conformed such as to abut the first sheet of the tubular container; the third arm being mobile between a first retracted position and a second advanced position in which the fifth hinge axis is closer to the receiving station; the fourth arm being mobile between a first retracted angular position and a second advanced angular position in which the relative first portion is closer to the receiving station; the unit being designed such that: in an initial pick-up configuration of the tubular container from the pick-up position, the third arm is in the first retracted position and the fourth arm is in the first retracted angular position such that the first aspirating means can be activated such as to intercept the first side of the first sheet of the tubular container; in a final release configuration of the tubular container at the receiving station, the third arm is in the second advanced position and the fourth arm is in the second advanced angular position such that the first aspirating means can be deactivated such as to release the tubular container in the receiving station; during rotation of the fourth arm from the first retracted angular position to the second advanced angular position the fifth arm is moved such as to abut the second side of the first sheet of the tubular container and to open out the tubular container.

The unit of the invention can be functionally interposed between a store and a station for receiving the containers which are opened-out. This invention is advantageously particularly compact and can guarantee high standards of productivity, the tubular container transferred towards the receiving station and contemporaneously opened out.

BRIEF DESCRIPTION OF THE DRAWINGS

Specific embodiments of the invention will be described in the following of the present description, according to what is set down in the claims and with the aid of the accompanying tables of drawings, in which:

DESCRIPTION OF PREFERRED EMBODIMENTS

With reference to the accompanying figures of the drawings, (1) denotes in its entirety a unit for picking up a tubular container (2) in a flattened configuration thereof, opening out the tubular container (2) and transferring the tubular container (2) towards a receiving station (R) of the tubular container (2).

Figure 5:
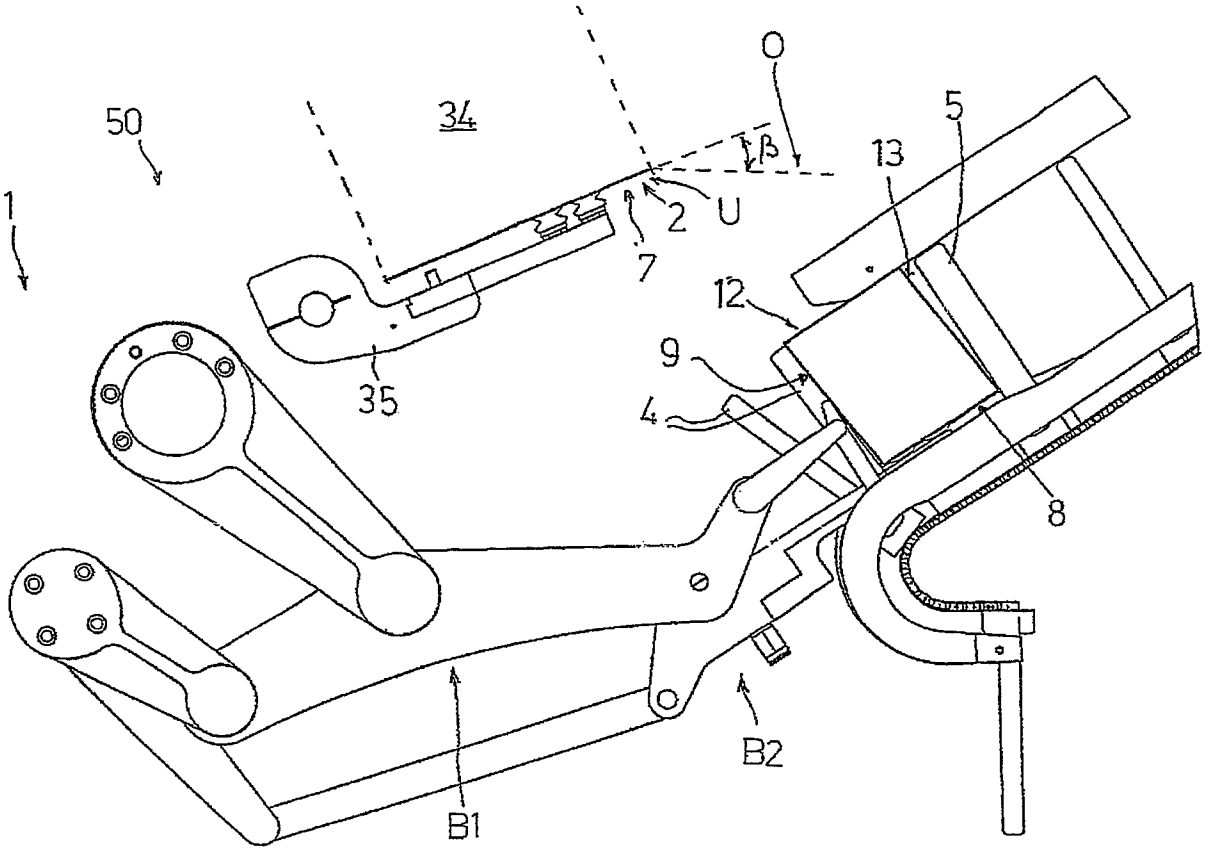

In the illustrated example, in the drawings the receiving station (R) is identified by a conveyor (3) (of known type) having two chains which bear elongate drawing elements (4) of an opened-out tubular container (2) and elongate abutting elements (5) of the tubular container (2) when opened out, see for example FIG. 5. The elongate drawing elements (4) and elongate abutting elements (5) move the tubular container (2) and maintain it stably opened out, such that it maintains the shape of a parallelepiped having two opposite openings, with the aim of subsequently introducing articles internally thereof, for example blister packs containing pills.

As already mentioned, a tubular container (2) in the flattened configuration comprises a first sheet (6) and a second sheet (7) which are in contact with one another or in close vicinity to one another; the first sheet (6) is connected to the second sheet (7) at two common and opposite ends. The first sheet (6) is provided with a first side (8) and a second side (9) that are separated from one another by a fold line (11); likewise, the second sheet (7) is provided with a third side (12) and a fourth side (13) which are separated from one another by a fold line (11) (not visible in the accompanying figures of the drawings). The tubular container (2) further comprises additional sides (not visible in the figures) which function as closing flaps of the tubular container (2).

The tubular container (2) is positionable in a pick-up position (P) (FIG. 1) such as to form a first angle ($\alpha$) with respect to a horizontal plane (O) and for making the first sheet (6) available for picking-up the tubular container (2) by the unit (1) of the invention.

The unit (1) comprises: a frame (not illustrated); a first arm (14) hinged to the frame at a first hinge axis (15); a second arm (16) hinged to the frame at a second hinge axis (17); a third arm (18) which is hinged to the first arm (14) at a third hinge axis (19) and which is articulated to the second arm (16) at a fourth hinge axis (20); the frame, the first arm (14), the second arm (16) and the third arm (18) forming a four-bar linkage; a fourth arm (21) which is hinged to the third arm (18) at a fifth hinge axis (22) and which bears first aspirating means (23) of the tubular container (2) located at a first portion (24) of the fourth arm (21); a fifth arm (25) which is hinged to the fourth arm (21) at a sixth hinge axis (26) and which is conformed such as to abut the first sheet (6) of the tubular container (2); the third arm (18) being mobile between a first retracted position (A1) and a second advanced position (B1) in which the fifth hinge axis (22) is closer to the receiving station (R); the fourth arm (21) being mobile between a first retracted angular position (A2) and a second advanced angular position (B2) in which the relative first portion (24) is closer to the receiving station (R).

The unit (1) is designed such that: in an initial pick-up configuration of the tubular container (2) from the pick-up position (P) (FIGS. 2, 2*a*), the third arm (18) is in the first retracted position (A1) and the fourth arm (21) is in the first retracted angular position (A2) such that the first aspirating means (23) can be activated such as to intercept the first side (8) of the first sheet (6)of the tubular container (2); in a final release configuration of the tubular container (2) at the receiving station (R) (FIG. 5), the third arm (18) is in the second advanced position (B1) and the fourth arm (21) is in the second advanced angular position (B2) such that the first aspirating means (23) can be deactivated such as to release the tubular container (2) in the receiving station (R); during rotation of the fourth arm (21) from the first retracted angular position to the second advanced angular position (B2) the fifth arm (25) is moved such as to abut the second side (9) of the first sheet (6) of the tubular container (2) and to open out the tubular container (2).

The unit (1) can comprise a sixth arm (27 which is hinged at an end to the third arm (18) at a seventh hinge axis (28) and which is hinged at another end thereof to the fifth arm (25) at an eighth hinge axis (29), the dimensioning of the sixth arm (27) and the position selected for the seventh hinge axis (28) and for the eighth hinge axis (29) being such that the rotation of the fourth arm (21) from the first retracted angular position (A2) to the second advanced angular position (B2) determines the consequent movement of the fifth arm (25) such as to abut the second side (9) of the first sheet (6) of the tubular container (2) and open out the tubular container (2).

Figure 4:
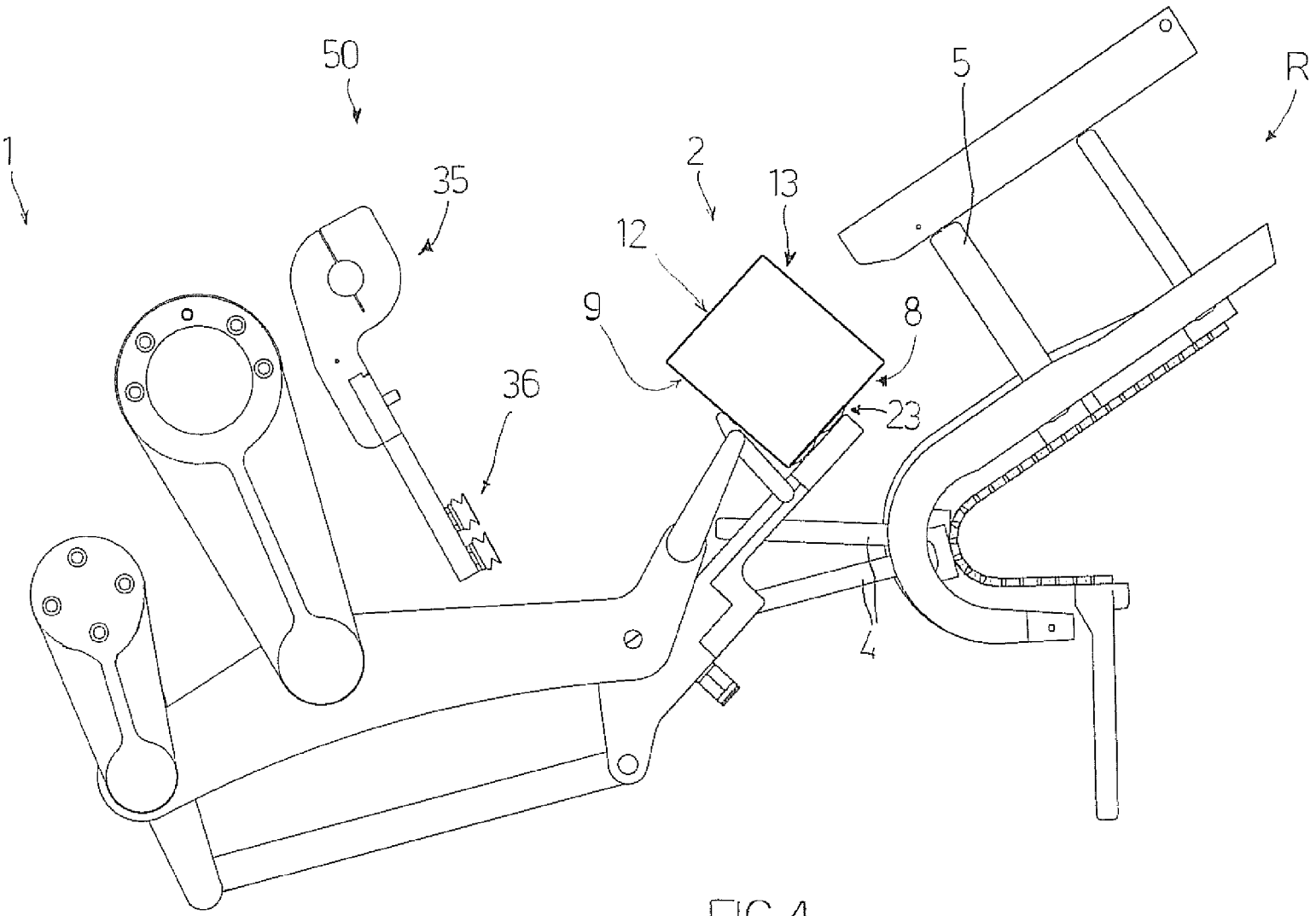

The activation of the fifth arm (25) is advantageously simplified: this activation, in fact, is done automatically during the rotation of the fourth arm (21). During the rotation, the second side (9) is rotated by the fifth arm (25) with respect to the first side (8), which is constrained to the first aspirating means (23), up to taking on an angle of about ninety degrees with respect to the first side (8) (FIGS. 4, 5).

The eighth hinge axis (29) can be at an end of the sixth arm (27) and at an intermediate portion of the fifth arm (25) located between the two ends of the fifth arm (25).

The unit (1) can further comprise: a seventh arm (30) which is hinged to the frame at the first hinge axis (15); an eighth arm (31) which is hinged to the seventh arm (30) at a ninth hinge axis (32) and which is hinged to the fourth arm (21) at a tenth hinge axis (33); and motor means which act on the first arm (14) and on the seventh arm (30) such as to command respectively the third arm (18) and the fourth arm (21).

It is advantageously possible to control the functioning of the unit (1) of the invention by means of a sole activation; the motor means can indeed comprise a single motor (not illustrated) which contemporaneously commands the rotation of the first arm (14) and the seventh arm (30).

The distance between the fifth hinge axis (22) and the tenth hinge axis (33) represents the activating "lever" in rotation of the fourth arm (21).

The first aspirating means (23) can comprise suction cups.

The first portion (24) of the fourth arm (21) can be at the free end of the fourth arm (21), opposite the end at which the fifth hinge axis (22) is situated. The present invention further relates to an apparatus (50) for collecting a tubular container (2) in the flattened configuration thereof from a store (34), for opening out the tubular container (2) and for transferring the tubular container (2) towards the receiving station (R) of the tubular container (2). The store (34) has been schematically represented only in FIG. 5.

The apparatus (50) comprises the unit (1) of the invention as described above, which unit (1) is positionable such that the third arm (18) thereof operates below the outlet (U) of the store (34) which makes available a tubular container (2) in a flattened configuration orientated at a second angle ($\beta$) with respect to the horizontal plane (O); and a rotating pick-up arm (35) which bears second aspirating means (36) and which is positionable with respect to the store (34) for picking-up a container in a flattened configuration from the store (34) and making it available to the unit (1) in the pick-up position (P).

The pick-up arm (35) has an important function: it causes a rotation of the tubular container (2) by an angle equal to the sum of the first angle ($\alpha$) and the second angle ($\beta$) such as to arrange the tubular container (2) in the pickup position (P) which is more suitable for the purposes of being picked up by the unit (1). It would be more complicated, in fact, to design a unit (1) able to pick up the tubular container (2) directly from the outlet (U) of the store (34); alternatively it would be necessary to modify the store (34), which would incur a certain cost and might be complicated in terms of design and mechanically. If conventional stores are used, the rotating pick-up arm (35) is an important aid for the best possible functioning of the unit (1).

The rotating pick-up arm (35) can be positionable with respect to the outlet (U) of the store (34) and with respect to the unit (1) such that the second aspirating means (36) intercept the second sheet (7) of the tubular container (2), such that the phase relation between the deactivation of the second aspirating means (36) and the activation of the first aspirating means (23) makes it possible to detach the first sheet (6) of the tubular container (2) from the second sheet (7) of the tubular container (2).

A partial pre-opening (or partial opening-out) of the tubular container (2) would advantageously be obtained, such as to guarantee the following complete opening of the tubular container (2) by the unit (1).

The rotating pick-up arm (35) can operate above the third arm (18) of the unit (1).

Figure 1:
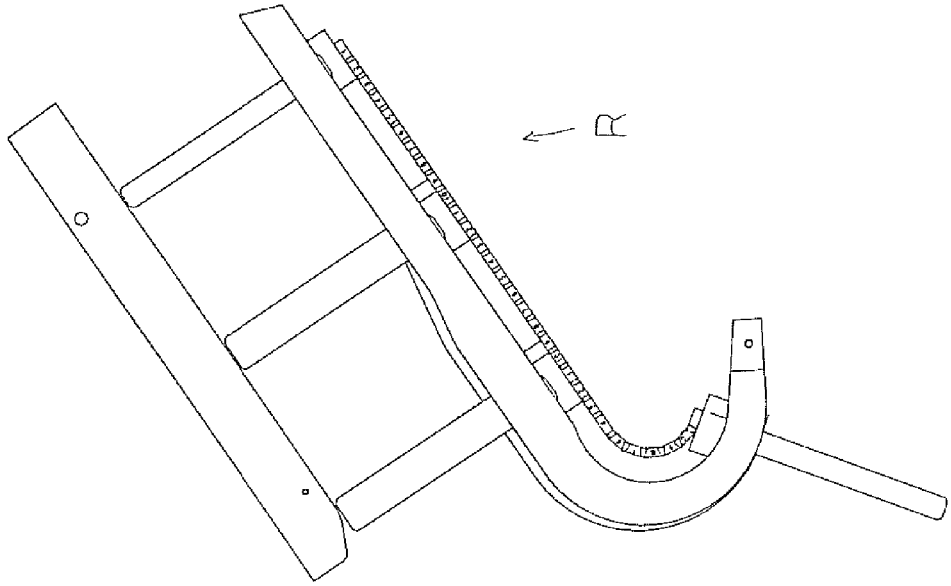
FIGS. 1, 2, 3, 4, 5 are lateral views in which the unit of the present invention is illustrated in five operating steps.
Figure 1:
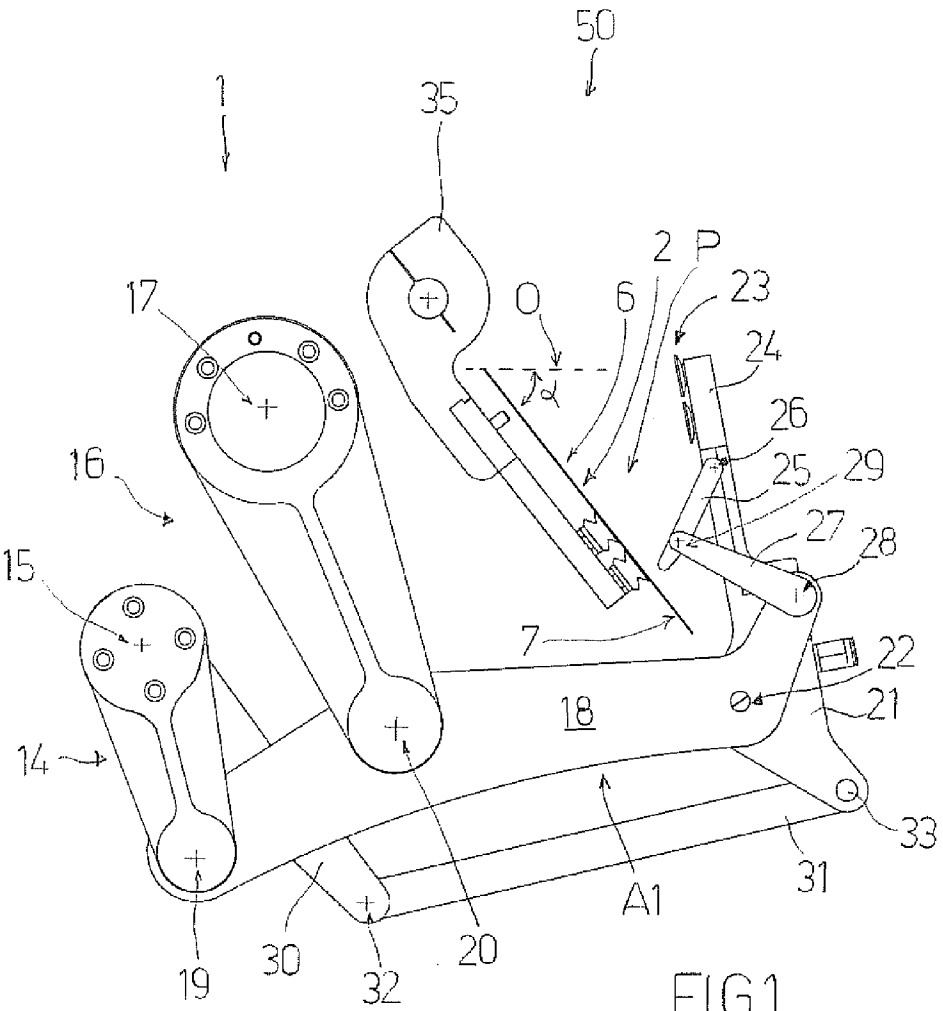

FIG. 1 illustrates the step in which the tubular container (2) is in the pick-up position (P), retained by the second aspirating means (36) by means of the corresponding suckers mounted on the rotating pick-up arm (35). The tubular container (2) is arranged according to the first angle ($\alpha$) with respect to the horizontal plane (O).

Figure 2:
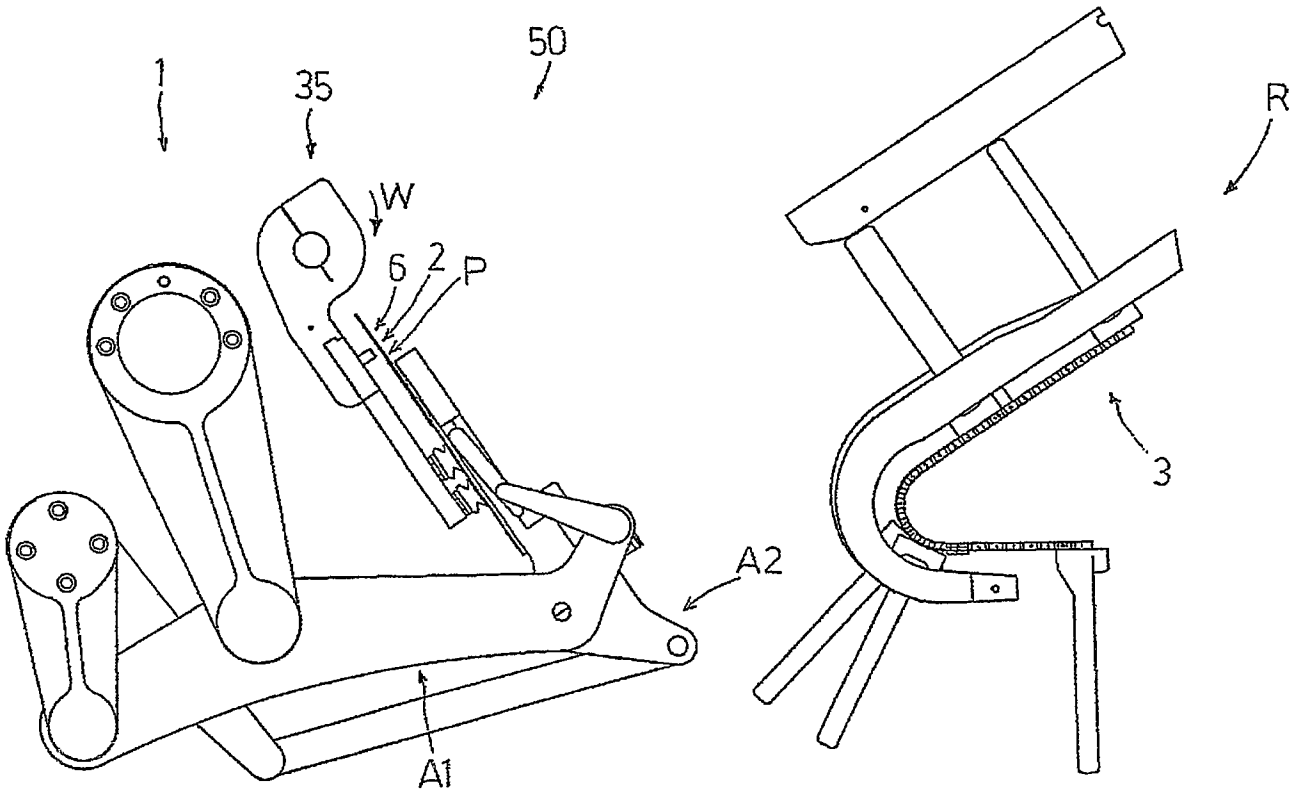

FIG. 2 illustrates the step corresponding to the unit (1) of the invention in the initial configuration of picking up the tubular container (2) from the pick-up position (P): the third arm (18) is in the first retracted position (A1) and the fourth arm (21) is in the first angular retracted position (A2) such that the first aspirating means (23) can be activated to intercept the first side (8) of the first sheet (6) of the tubular container (2).

To realize the pre-opening of the tubular container (2) the first aspirating means (23) and the second aspirating means (36) can be maintained activated and contemporaneously the fourth arm (21) can be removed towards the second advanced angular position (B2); additionally, there could be also a contained rotation of the rotating pick-up arm (35) rotating in the direction which in FIG. 2 is clockwise, i.e. in a direction that is such as to cause the distancing of the rotating pick-up arm (35) from the tubular container (2) which is in the pick-up position (P).

Although this further rotation of the rotating pick-up arm (35) is not illustrated in the accompanying figures, FIG. 2 illustrates the rotation direction (W) in which the pick-up arm (35) could be rotated, corresponding to a further distancing of the pick-up arm (35) from the store (34).

Figure 3:
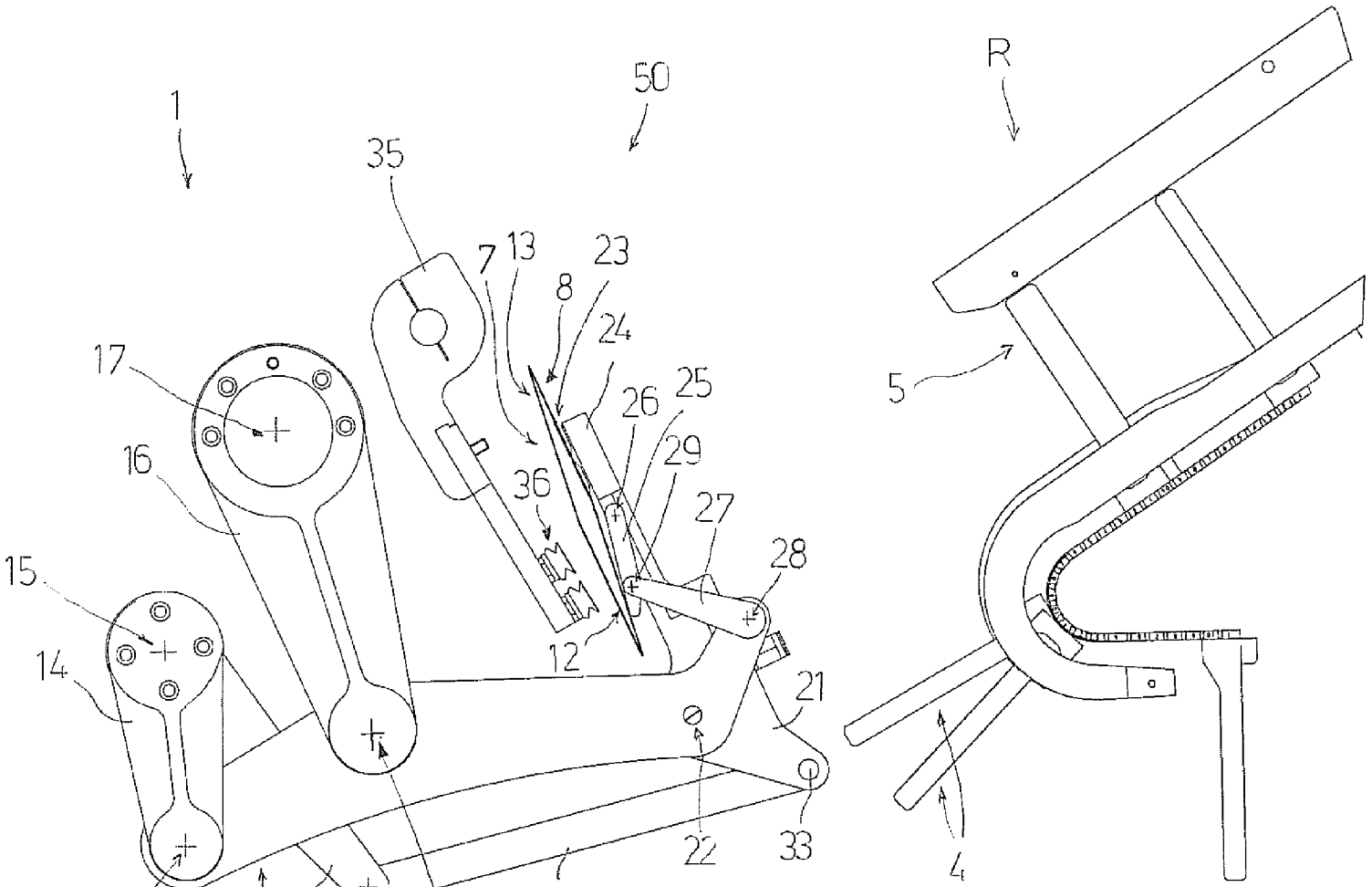

Following this, the second aspirating means (36) are deactivated and the fourth arm (21) is rotated towards the second advanced angular position (B2), see FIG. 3; at the same time a rotation is performed of the fifth arm (25) in order to open out the tubular container (2), i.e. in order to bring the second side (9) of the first sheet (6) of the tubular container (2) to assume an angle of about ninety degrees with respect to the first side (8) of the first sheet (6) of the tubular container (2).

FIG. 4 shows how the angle between the first side (8) of the first sheet (6) and the second side (9) of the first sheet (6) is about ninety degrees; further, the third arm (18) has been moved towards the second advanced position (B1).

Next, the rotating pick-up arm (35) is rotated such as to go and pick up another tubular container (2) in a flattened configuration on exit (U) from the store (34), which tubular container (2) in the flattened configuration exhibits at the exit (U) of the store (34) a second angle ($\beta$) with respect to the horizontal plane (O). Further, the unit (1) of the invention assumes the final release configuration of the tubular container (2) at the receiving station (R); in fact, the third arm (18) is in the second advanced position (B1) and the fourth arm (21) is in the second advanced angular position (B1) so that the first aspirating means (23) can be deactivated to release the tubular container (2) in the receiving station. See FIG. 5.

The tubular container (2) is then drawn by the elongate drawing elements (4) and abutted by the elongate abutting elements (5) in order to be transferred towards a filling station of articles internally thereof (FIG. 5).

After this, the rotating pick-up arm (35), via the activation of the second aspirating means (36), brings the tubular container (2) from the exit (U) of the store (34) to the pick-up position (P) and the operating cycle is newly repeated.

Figure 2A:
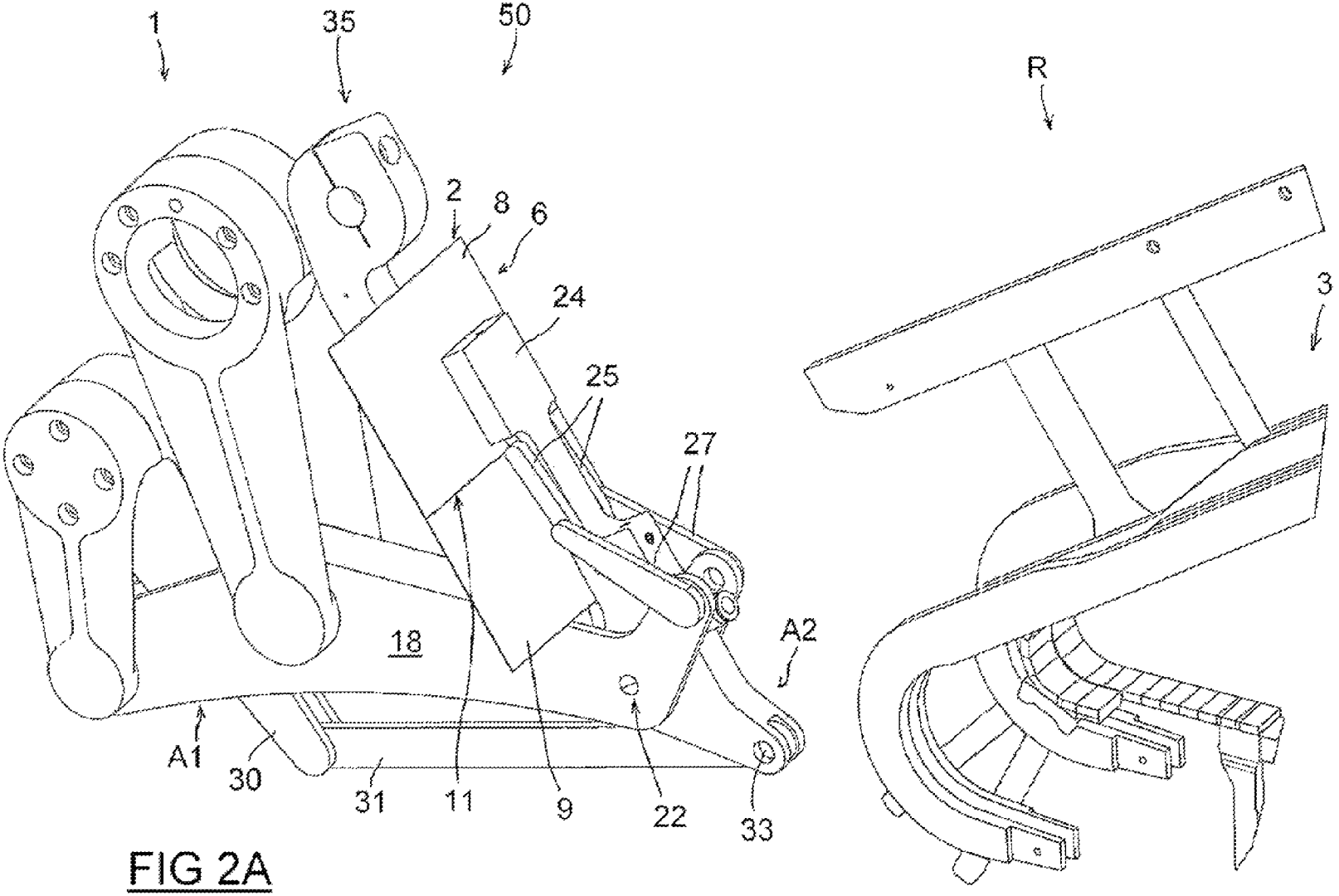
FIG. 2A is a perspective view of the unit during an operating step corresponding to the view illustrated in FIG. 2.

In the embodiment illustrated in the figures, the sixth arm (27) and the fifth arm (25) are both comprised in two units (see FIG. 2A).

The above is understood to have been described by way of non-limiting example, and any eventual constructional variants are considered to fall within the protective scope of the present technical solution, as claimed in the following.

The invention claimed is:

1. A unit (1) for picking up a tubular container (2) in a flattened configuration, for opening out the tubular container (2) and for transferring the tubular container (2) towards a receiving station (R) for the tubular container (2), the tubular container (2) in the flattened configuration comprising a first sheet (6) and a second sheet (7) which are in contact with one another, the first sheet (6) being connected to the second sheet (7) at two common and opposite ends, the first sheet (6) being provided with a first side (8) and a second side (9) that are separated from one another by a fold line (11), the tubular container (2) being positionable in a pick-up position (P) such as to form a first angle ($\alpha$) with respect to a horizontal plane (O) and for making the first sheet (6) available for picking up the tubular container (2), the unit (1) being positionable adjacent to the receiving station (R) for the tubular container (2) and wherein it comprises:

a frame;

a first arm (14) hinged to the frame at a first hinge axis (15);

a second arm (16) hinged to the frame at a second hinge axis (17);

a third arm (18) which is hinged to the first arm (14) at a third hinge axis (19) and which is articulated to the second arm (16) at a fourth hinge axis (20);

the frame, the first arm (14), the second arm (16) and the third arm (18) forming a four-bar linkage;

a fourth arm (21) which is hinged to the third arm (18) at a fifth hinge axis (22) and which bears first aspirating means (23) of the tubular container (2) located at a first portion (24) of the fourth arm (21);

a fifth arm (25) which is hinged to the fourth arm (21) at a sixth hinge axis (26) and which is conformed such as to abut the first sheet (6) of the tubular container (2);

the third arm (18) being mobile between a first retracted position (A1) and a second advanced position (B1) in which the fifth hinge axis (22) is closer to the receiving station (R);

the fourth arm (21) being mobile between a first retracted angular position (A2) and a second advanced angular position (B2), the first portion (24) being closer in the second advanced angular position B2 than in the first retracted angular position A2, relative to the receiving station (R);

the unit (1) being configured such that:

in an initial pick-up configuration of the tubular container (2) from the pick-up position (P), the third arm (18) is in the first retracted position (A1) and the fourth arm (21) is in the first retracted angular position (A2) such that the first aspirating means (23) can be activated so as to intercept the first side (8) of the first sheet (6) of the tubular container (2);

in a final release configuration of the tubular container (2) at the receiving station (R), the third arm (18) is in the second advanced position (B1) and the fourth arm (21) is in the second advanced angular position (B2) so that the first aspirating means (23) can be deactivated to release the tubular container (2) in the receiving station (R);

during rotation of the fourth arm (21) from the first retracted angular position to the second advanced angular position (B2) the fifth arm (25) is moved so as to abut the second side (9) of the first sheet (6) of the tubular container (2) and to open out the tubular container (2).

2. The unit (1) of the claim 1, further comprising a sixth arm (27 which is hinged at an end to the third arm (18) at a seventh hinge axis (28) and which is hinged at another end thereof to the fifth arm (25) at an eighth hinge axis (29), the dimensioning of the sixth arm (27) and the position selected for the seventh hinge axis (28) and for the eighth hinge axis (29) being such that the rotation of the fourth arm (21) from the first retracted angular position (A2) to the second advanced angular position (B2) determines the consequent movement of the fifth arm (25) so as to abut the second side (9) of the first sheet (6) of the tubular container (2) and open out the tubular container (2).

3. The unit (1) of claim 2, wherein the eighth hinge axis (29) is at an end of the sixth arm (27) and at an intermediate portion of the fifth arm (25) located in between two ends thereof.

4. The unit (1) of claim 2, further comprising:

a seventh arm (30) which is hinged to the frame at the first hinge axis (15);

an eighth arm (31) which is hinged to the seventh arm (30) at a ninth hinge axis (32) and which is hinged to the fourth arm (21) at a tenth hinge axis (33); and, motors which act on the first arm (14) and on the seventh arm (30) such as to command respectively the third arm (18) and the fourth arm (21).

5. The unit (1) of claim 2, further comprising:

a seventh arm (30) which is hinged to the frame at the first hinge axis (15);

an eighth arm (31) which is hinged to the seventh arm (30) at a ninth hinge axis (32) and which is hinged to the fourth arm (21) at a tenth hinge axis (33); and, a motor which acts on the first arm (14) and on the seventh arm (30) such as to command respectively the third arm (18) and the fourth arm (21).

6. The unit (1) of claim 1, wherein the first aspirating means (23) comprise suction cups.

7. The unit (1) of claim 1, wherein the first portion (24) of the fourth arm (21) is at the free end of the fourth arm (21).

8. An apparatus (50) for picking up a tubular container (2) in a flattened configuration from a store (34), for opening-out the tubular container (2) and for transferring the tubular container (2) towards a receiving station (R) for the tubular container (2), the apparatus comprising:

a unit (1) for picking up a tubular container (2) in a flattened configuration, for opening out the tubular container (2) and for transferring the tubular container (2) towards a receiving station (R) for the tubular container (2), the tubular container (2) in the flattened configuration comprising a first sheet (6) and a second sheet (7) which are in contact with one another, the first sheet (6) being connected to the second sheet (7) at two common and opposite ends, the first sheet (6) being provided with a first side (8)and a second side (9) that are separated from one another by a fold line (11), the tubular container (2) being positionable in a pick-up position (P) such as to form a first angle ($\alpha$) with respect to a horizontal plane (O) and for making the first sheet (6) available for picking up the tubular container (2), the unit (1) being positionable adjacent to a receiving station (R) for the tubular container (2) and wherein it comprises:

a frame;

a first arm (14) hinged to the frame at a first hinge axis (15);

a second arm (16) hinged to the frame at a second hinge axis (17);

a third arm (18) which is hinged to the first arm (14) at a third hinge axis (19) and which is articulated to the second arm (16) at a fourth hinge axis (20);

the frame, the first arm (14), the second arm (16) and the third arm (18) forming a four-bar linkage;

a fourth arm (21) which is hinged to the third arm (18) at a fifth hinge axis (22) and which bears first aspirating means (23) of the tubular container (2) located at a first portion (24) of the fourth arm (21);

a fifth arm (25) which is hinged to the fourth arm (21) at a sixth hinge axis (26) and which is conformed such as to abut the first sheet (6) of the tubular container (2);

the third arm (18) being mobile between a first retracted position (A1) and a second advanced position (B1) in which the fifth hinge axis (22) is closer to the receiving station (R);

the fourth arm (21) being mobile between a first retracted angular position (A2) and a second advanced angular position (B2), the first portion (24) being closer in the second advanced angular position B2 than in the first retracted angular position A2, relative to the receiving station (R);

the unit (1) being configured such that:

in an initial pick-up configuration of the tubular container (2) from the pick-up position (P), the third arm (18) is in the first retracted position (A1) and the fourth arm (21) is in the first retracted angular position (A2) such that the first aspirating means (23) can be activated so as to intercept the first side (8) of the first sheet (6) of the tubular container (2);

in a final release configuration of the tubular container (2) at the receiving station (R), the third arm (18) is in the second advanced position (B1) and the fourth arm (21) is in the second advanced angular position (B2) so that the first aspirating means (23) can be deactivated to release the tubular container (2) in the receiving station (R);

during rotation of the fourth arm (21) from the first retracted angular position to the second advanced angular position (B2) the fifth arm (25) is moved so as to abut the second side (9) of the first sheet (6) of the tubular container (2) and to open out the tubular container (2), the unit (1) being positionable such that the third arm (18) thereof operates on one side of an outlet (U) of a store (34) which makes available a tubular container (2) in a flattened configuration orientated at a second angle (($\beta$) with respect to the horizontal plane (O); and a rotating pick-up arm (35) which bears second aspirating means (36) and which is positionable with respect to the store (34) for picking-up a container in a flattened configuration from the store (34) and making it available to the unit (1) in the pick-up position (P).

9. The apparatus (50) of claim 8, wherein the rotating pick-up arm (35) is positionable with respect to the outlet (U) of the store (34) and with respect to the unit (1) such that the second aspirating means (36) intercept the second sheet (7) of the tubular container (2), such that the phase relation between the deactivation of the second aspirating means (36) and the activation of the first aspirating means (23) permits detachment of the first sheet (6) of the tubular container (2) from the second sheet (7) of the tubular container (2).

10. The apparatus (50) of claim 9, wherein the rotating pick-up arm (35) operates on substantially one side of the third arm (18) of the unit (1).

11. The apparatus (50) of claim 8, wherein the rotating pick-up arm (35) operates on substantially one side of the third arm (18) of the unit (1).

* * * * *